United States Patent [19]

Kranz

[11] Patent Number: 4,964,593

[45] Date of Patent: Oct. 23, 1990

[54] MISSILE HAVING ROTOR RING

[75] Inventor: Walter Kranz, Taufkirchen, Fed. Rep. of Germany

[73] Assignee: Messerschmitt-Bölkow-Blohm GmbH, Munich, Fed. Rep. of Germany

[21] Appl. No.: 389,174

[22] Filed: Aug. 3, 1989

[30] Foreign Application Priority Data

Aug. 13, 1988 [DE] Fed. Rep. of Germany ..... 3827590

[51] Int. Cl.[5] ..... F42B 10/02

[52] U.S. Cl. ..... 244/3.24; 244/3.23; 102/208

[58] Field of Search ..... 244/3.24, 3.23, 3.21; 102/208

[56] References Cited

U.S. PATENT DOCUMENTS

| | | | |
|---|---|---|---|
| 4,076,187 | 2/1978 | Metz | 244/3.23 |
| 4,426,048 | 1/1984 | Mildren | 244/3.23 |
| 4,512,537 | 4/1985 | Sebestyen et al. | 244/3.21 |
| 4,565,340 | 1/1986 | Bains | 244/3.21 X |

*Primary Examiner*—Charles T. Jordan
*Assistant Examiner*—Michael Carone
*Attorney, Agent, or Firm*—Kenyon & Kenyon

[57] ABSTRACT

A missile having a rotor ring, which has at least one adjustable fin actuated by the relative rotation between the rotor ring and the missile. At least one motor is arranged between the rotor ring and the missile, and a control device is provided which allows the motor to work as a generator and performs the fin adjustment.

12 Claims, 3 Drawing Sheets

FIG. 4
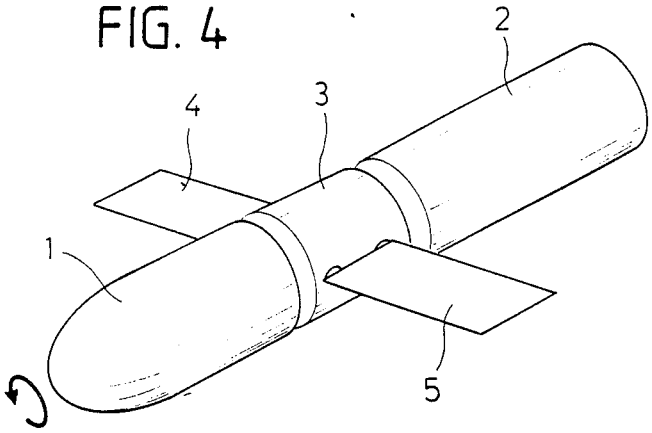
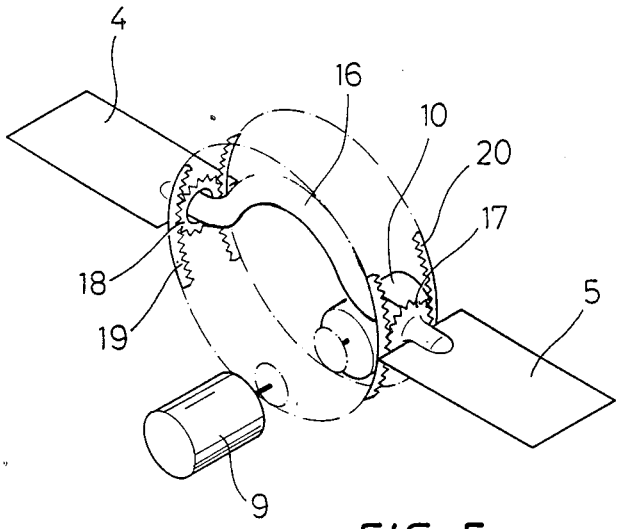
FIG. 5

MISSILE HAVING ROTOR RING

BACKGROUND OF THE INVENTION

The present invention relates to a missile having a rotor ring, which has at least one adjustable fin, which can be actuated by means of the relative rotation between the rotor ring and the missile.

Such a missile can execute a rolling motion about its longitudinal axis, in accordance with the position of its attached fin, whereby the rotor ring does not rotate about its longitudinal axis, when the angle of pitch of its fins is adjusted accordingly. On the other hand, the missile can follow its trajectory without a rolling motion, while the rotor ring can rotate about it longitudinal axis, when the angle of pitch of its fins is adjusted accordingly. In both cases, therefore, a relative rotation between the rotor ring and the missile is obtained.

A missile is known from the U.S. Pat. No. 3,111,088, which is comprised of two sections. The front section has a seeker head and the back section is provided with a driving arrangement. Both sections can roll in opposite rotative directions about the longitudinal axis, whereby the rear section is provided with an electromagnetic generator, which can be actuated by means of the rolling motions of the front section or by means of the opposite rolling motions of both sections relative to each other. A magnetic brake is thereby assigned to the generator, allowing the rolling motion of the front section to be interrupted.

SUMMARY OF THE INVENTION

An object of the present invention is to further improve the maneuvering capability of such a missile by means of an easily built, flexible duty-type servo-system.

The above and other objects of the invention are achieved by a missile having a rotor ring having at least one adjustable fin actuated by the relative rotation between the rotor ring and the missile, at least one motor being arranged between the rotor ring and the missile and further comprising a control device for allowing the motor to work as a generator and for performing the fin adjustment.

It is advantageous that the rotor ring has two fins which are rigidly connected to each other, while the missile has two motors/generators, which adjust both fins.

The control device advantageously has a measuring circuit to determine the angle of pitch $\alpha$ of the rotor fin, a measuring circuit to determine the angle of torque $\beta$ between the fin and the missile, and a measuring circuit to determine the angle $\delta$ of the fin axis compared with a spatial coordinate system.

The missile, according to the invention, has the advantage of less aerodynamic resistance and a lesser weight. It also entails less expenditure for construction. A constantly rotating missile sustains the motors/generators in the optimum rotational speed range, allowing the maximum capacity of the motors to be utilized. When the "pitching"command is given, the electrical braking energy of one motor can be utilized to drive the second motor. The peak load of the electrical battery is, thereby reduced allowing for a weight reduction.

BRIEF DESCRIPTION OF THE DRAWINGS

The invention will be described in greater detail in the following detailed description with reference to the drawings, in which:

FIG. 4 shows a second exemplified embodiment of a missile with a stationary rotor ring; and FIG. 5 shows an enlarged representation of an exemplified embodiment of the rotor ring.

DETAILED DESCRIPTION

Figure 1:
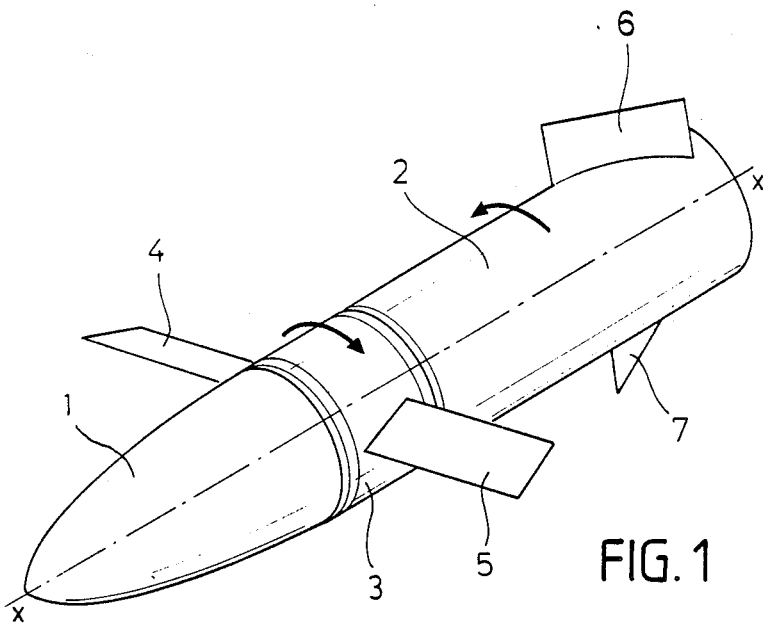
FIG. 1 shows a first exemplified embodiment of a missile with a constantly rotating rotor ring.

In the case of the exemplified embodiment shown in FIG 1, a missile is represented, which has a front section 1 and a rear section 2, which are rigidly connected to each other. A rotor ring 3 is provided between both of these sections, which has at least one pair of adjustable fins 4, 5. In the selected exemplified embodiment, these fins are arranged offset from one another, so that the rotor ring 3 constantly rotates about the longitudinal axis of the missile.

The numbers 6, 7 designate two fins for the missile, which can be arranged, so that the missile executes a rolling motion about its longitudinal axis, whereby, as indicated by the arrows, the rotor ring and the missile have opposite rotary motions.

According to the invention and according to an advantageous design, two motors/generators 9, 10 are now provided in the missile. They can be actuated by means of the relative rotary motion between the missile and the rotor ring and by means of an electric control device, and can be controlled either as motors or as generators. The two fins 4, 5 are then rigidly interconnected by this arrangement.

Figure 2:
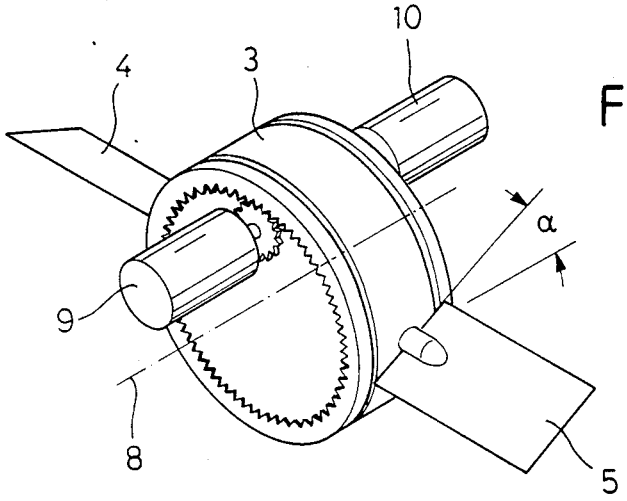
FIG. 2 shows an enlarged representation of the rotor ring and two motors/generators.

FIG. 2 schematically depicts an enlarged representation of the rotor ring 3 with both motors/generators 9, 10. The longitudinal missile axis, about which the rotor ring 3 rotates, is designated with 8. $\alpha$ designates the angle of pitch of the fins 4, 5 of the rotor ring. The motors/generators support a gear wheel, which is rigidly connected to their driving shaft and is engaged by way of internal gearing with the adjustment mechanism for adjusting the fins by the angle $\alpha$. The rotor ring serves as a bearing arrangement for the two fins and is pivoted on the missile between 1 and 2.

Figure 3:
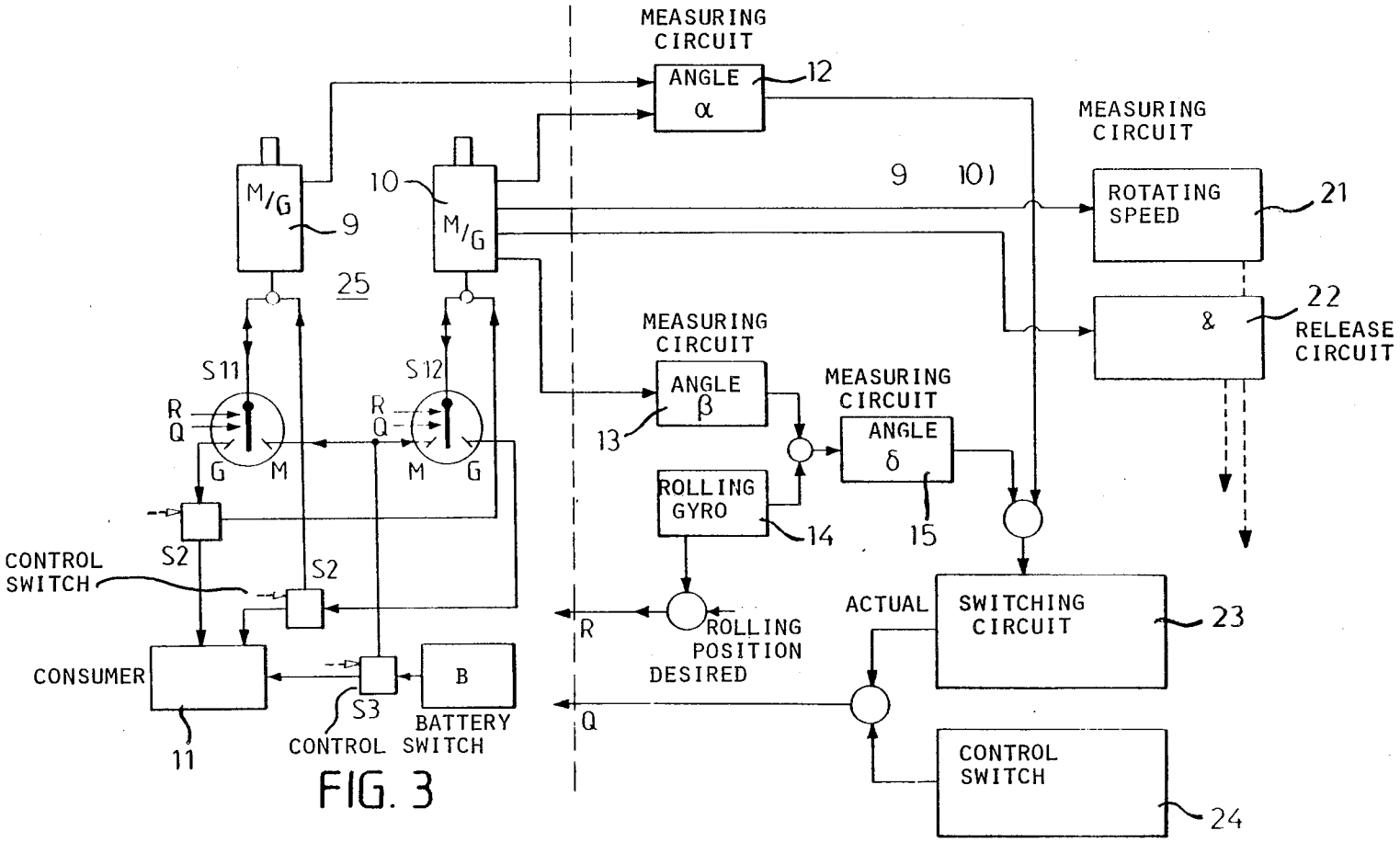
FIG. 3 shows a block diagram of a control device.

A block diagram of a control device for switching the motors 9, 10 to generator operation and back again and thus for controlling the fins, for example to generate a suitable transverse force in a defined spatial direction, is schematically depicted in FIG. 3. In the block diagram, reference numeral 12 designates a measuring circuit to determine the angle of pitch $\alpha$ of the fins 4, 5 of the rotor ring, 13 designates a measuring circuit to determine the angle $\beta$, that is the angle of torque between the fins and the missile, 14 designates a rolling gyro and 15 designates a measuring circuit to determine the angle $\delta$ between the fin axis and a spatial coordinate system, that is the surface of the earth.

Thereby, the measuring circuit 12 determines the displacement of the poles traversing between both motors/generators 9, 10 and from it, calculates the angle of pitch $\alpha$ of the fin of the rotor ring. The measuring circuit 13 adds up the traversing poles and from it, calculates the angle of rotation $\beta$ around the longitudinal axis of the missile. From this angle $\beta$ and the measuring result of the rolling gyro 14, the angle $\delta$ is formed by the fin axis measuring circuit 15. An additional measuring circuit 21, which is connected to the motors/generators 9, 10, calculates the rotative speed of the rotor ring around its longitudinal axis, for example by counting the traversing poles per unit of time. A measuring circuit 22 can be provided to release the safety device for the load and is likewise connected to the motors/generators 9, 10; for example after a defined number of pole variations has been executed, the safety device for the carried load of the missile can be released.

The measured values derived from the measuring circuit 12 and from the measuring circuit 15 serve to generate a transverse force on the missile in a defined spatial direction; the actual value of a switching circuit 23 required for this purpose is thereby compared to the nominal value for the transverse force on the missile in the required spatial direction of a control switching operation 24 and supplied to a corresponding circuitry 25 for the motors/generators in the power circuitry. When a "transverse force"command for a particular spatial direction is received, for example, 9 is driven as a generator by the control instrument S11 in position G and, by way of the control switching operation S2, the other driving mechanism 10 is driven as a motor. The control switching operation S2 divides the total consumption between the consumer 11 and the motor consumption. If necessary, the control instrument S12 in position M supports the motor-drive mechanism from the battery B over the control switching operation S3, which can also influence the consumer 11. Furthermore, it is possible that both parts 9, 10 work as motors or both as generators. In principle, each operating mode is adaptable to the requirements of the guidance system.

When high transverse forces are required for the short term, it is advantageous to brake one of the generators, while taking advantage of the inertia of the rotor ring and any additional rolling motion of the missile according to FIG. 1.

According to FIG. 1 or 2, in place of only two motors/generators 9, 10, it is also possible to use more than two motors/generators, which can run in both operating modes and can be coupled with the pair of fins over axes arranged parallel to the outer surface. Thus, an adaptability to different fin performances is given. An improved performance can also result, when four fins are used with two additional motors/generators.

When the fins 4, 5 of the rotor ring 3 are in a staggered arrangement, a roll stabilizing function in any angular position of the missile about its rolling axis is possible. The permanently staggered fins 4, 5 or also an asymmetrical mass distribution produce a constant driving torque. This forces a braking, that is a generator operation of the motors/generators 9, 10, for example, in the case of a roll stabilizing function. In this connection, the energy gained from the flow can be used to supply additional consumers or to drive a motor, when a transverse force is to be generated or, however, the moment of rotation on the rotor ring is accelerated as the result of reduced braking, that is reduced generator operation, when the generation of transverse force reduces the rotational frequency of the rotor ring.

This type of missile control system is especially flexible due to its generation of transverse force and/or rolling momentum in the motor or generator operation. One can freely choose the source of energy or also combinations thereof, that is, an electrical battery and incident flow of air. In this connection, the advantage is also attained, that the source of energy is available for additional electrical consumers.

Two generators suffice to generate transverse force and rolling momentum. The use of two generators only marginally complicates the assembly operation. The generators and the corresponding gear units work within a range showing a high efficiency factor, which is conditioned on the constantly rotating rotor ring. Thus, no passages through zero occur and, therefore, one avoids the known disadvantages, such as backlash and softness of the speed transformation.

In the exemplified embodiment depicted in FIG. 4, the missile 1, 2 executes rolling motions about its longitudinal axis, while the rotor ring 3 does not rotate. It remains, rather, in a glide position, since the fin axis lies parallel to the horizon. Also, in this connection, the front section I and the rear section 2 of the missile, especially as FIG. 5 shows, are provided respectively with a motor/generator 9, 10, which can be actuated by means of the relative rotary motion between the missile and the rotor ring.

The fin 4 can thereby be rigidly connected with a fin axis 16, which on the one side penetrates the rotor ring in a bushing 18 serving as a bearing and on its other end is rigidly connected to a bearing 17 designed as a gear wheel and to the second fin 5. The bearings 17, 18 provided with external gearing can interact with two brackets 19, 20 arranged parallel t o each other and likewise provided with gear wheels. The exemplified embodiment depicted in FIG. 5 differs from that of FIG. 2 essentially because the supports for the fin ring, that is the rotating area, which supports the fins 4, 5 is only still represented by the fin axis 16. The braking energy of the one motor/generator is also conducted in the form of electric current directly into the other motor/generator, when a transverse force is to be generated.

Due to the fact that the fins 4, 5 of the rotor ring 3 are not offset from one another, the aerodynamic fin resistance is minimized. The constantly rotating missile sustains the motors/generators, as well as the corresponding gear units in the optimum rotational frequency range, so maximum efficiency is attained.

The possible high rotational frequency of the motors/generators 9, 10 reduces their size and consequently their weight, so that it is possible to better accommodate the motors/generators or to accommodate more of them than only the two along the circumference of the missile.

In the foregoing specification, the invention has been described with reference to specific exemplary embodiments thereof It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A missile having a rotor ring, the rotor ring having at least one adjustable fin, the fin being actuated by relative rotation between the rotor ring and the missile, at least one motor means being arranged between the rotor ring and the missile and further comprising a control means for switching the motor between motor means and generator operation and for performing fin adjustment.

2. The missile recited in claim 1, wherein the control means comprises a power circuit having at least one control switch and the motor means comprises a motor/generator unit, the control switch being coupled to the unit.

3. The missile recited in claim 1, wherein the control means comprises a power circuit having at least two control switches and the motor means comprises at least one unit of two motors/generators coupled to each other by gearing, the control switches being coupled to the unit.

4. The missile recited in claim 1, wherein a second fin is rigidly connected to the first fin.

5. The missile recited in claim 3, wherein the control means further comprises at least one control switching means provided in a generator output circuit to divide power from one of said motor/generators functioning as a generator between a consumer and the other of said motor/generators functioning as a motor.

6. The missile recited in claim 3, wherein the control means further comprises a control switching means provided coupling a battery, a consumer and the motor/generator unit for dividing power from the battery between one of said motor/generators functioning as a motor and the consumer.

7. The missile recited in claim 5, wherein the control switches and the control switching means comprise semiconductor circuits.

8. The missile recited in claim 1, wherein the control means has a measuring circuit to set an angle of torque $\beta$ between the fin and the missile.

9. The missile recited in claim 1, wherein the control mans has a measuring circuit to determine an angle $\delta$ of the fin axis compared to a spatial coordinate system.

10. A method for determining the angle of pitch $\alpha$ of a fin of a missile having a rotor ring, the fin being mounted on the rotor ring and being adjustable, the fin being actuated by relative rotation between the rotor ring and the missile, at least two motors being arranged between the rotor ring and the missile and a control means being provided for switching the motors between motor and generator operation and for performing fin adjustment, the method comprising the steps of measuring displacement of traversing poles of both motors relative to each other and from said measurement, calculating the angle of pitch $\alpha$.

11. A method for determining the angle of torque $\beta$ between a fin of a missile and the missile in a missile having a rotor ring, the fin being mounted on the rotor ring and being adjustable, the fin being actuated by relative rotation between the rotor ring and the missile, at least two motors being arranged between the rotor ring and the missile and a control means being provided for switching the motors between motor and generator operation and for performing fin adjustment, the method comprising the steps of measuring a sum of traversing poles of one of the motors and from the measurement, calculating the angle $\beta$.

12. A method for determining the angle $\delta$ of the fin axis of a missile opposite a spatial coordinate system in a missile having a rotor ring, the fin being mounted on the rotor ring and being adjustable, the fin being actuated by relative rotation between the rotor ring and the missile, at least one motor being arranged between the rotor ring and the missile and a control means being provided for switching the motor between motor and generator operation and for performing fin adjustment, the method comprising the step of calculating the angle $\delta$ from the actual value of a rolling gyro and from the angle of torque $\beta$ between the fin and the missile.

* * * * *